US005265861A

United States Patent [19]

Schaffner et al.

[11] Patent Number: 5,265,861

[45] Date of Patent: Nov. 30, 1993

[54] SHEET BRAKING METHOD AND DEVICE WITH DOWNWARD DEFLECTION OF SHEET ENDS FOR SHINGLING

[75] Inventors: Georg Schaffner, Neuss; Egbert Most, Düsseldorf; Ewald G. Welp, Erkrath; Ingo Becker, Düsseldorf; Peter Naudascher, Hilden, all of Fed. Rep. of Germany

[73] Assignee: Jagenberg Aktiengesellschaft, Dusseldorf, Fed. Rep. of Germany

[21] Appl. No.: 741,419

[22] PCT Filed: Dec. 11, 1990

[86] PCT No.: PCT/EP90/02143

§ 371 Date: Jul. 30, 1991

§ 102(e) Date: Jul. 30, 1991

[87] PCT Pub. No.: WO91/08974

PCT Pub. Date: Jun. 27, 1991

[30] Foreign Application Priority Data

Dec. 12, 1989 [DE] Fed. Rep. of Germany ..... 3940960

[51] Int. Cl.[5] ..... B65H 29/68

[52] U.S. Cl. ..... 271/182; 271/203

[58] Field of Search ..... 271/182, 198, 202, 203, 271/272, 273, 277

[56] References Cited

U.S. PATENT DOCUMENTS

| | | | |
|---|---|---|---|
| 2,152,288 | 3/1939 | Seybold | 271/203 |
| 3,827,545 | 8/1974 | Buhayar | 271/203 X |
| 4,461,467 | 7/1984 | Herb | 271/202 |
| 4,516,759 | 5/1985 | Kobler | 271/182 X |
| 4,995,859 | 2/1991 | Totani | 271/182 X |

FOREIGN PATENT DOCUMENTS

| | | | |
|---|---|---|---|
| 1243966 | 7/1967 | European Pat. Off. . | |
| 13476 | 7/1980 | European Pat. Off. | 271/182 |
| 0270793A1 | 10/1987 | European Pat. Off. . | |
| 503996 | 7/1930 | Fed. Rep. of Germany | 271/182 |
| 627018 | 2/1936 | Fed. Rep. of Germany . | |
| 1162675 | 2/1964 | Fed. Rep. of Germany . | |
| 1461244 | 12/1968 | Fed. Rep. of Germany . | |
| 2114865 | 10/1972 | Fed. Rep. of Germany . | |
| 2757448A1 | 7/1978 | Fed. Rep. of Germany . | |
| 3007435A1 | 10/1981 | Fed. Rep. of Germany . | |
| 3332809 | 3/1985 | Fed. Rep. of Germany | 271/182 |
| 3418344 | 8/1987 | Fed. Rep. of Germany . | |
| 61293 | 7/1970 | France . | |
| 244845 | 10/1987 | Japan | 271/277 |
| 225233 | 9/1990 | Japan | 271/198 |
| 1499104 | 1/1978 | United Kingdom | 271/182 |

*Primary Examiner*—Robert P. Olszewski
*Assistant Examiner*—Boris Milef
*Attorney, Agent, or Firm*—Herbert Dubno

[57] ABSTRACT

A method and apparatus for the stacking of paper engages the oncoming sheets at their rear ends between clamping elements on upper and lower belts and is so provided that the rear ends are deflected perpendicular to the direction of feed so that the oncoming sheets can effectively shingle over underlying sheets. The clamping portions are engaged at the feeding speed of the sheets at the moment of initial contact, are then slowed down to reduce the speed of the sheets, then release the sheets and then return to the usual speed for the pickup of the next sheet.

6 Claims, 7 Drawing Sheets

SHEET BRAKING METHOD AND DEVICE WITH DOWNWARD DEFLECTION OF SHEET ENDS FOR SHINGLING

CROSS REFERENCE TO RELATED APPLICATION

This application is a National Phase of PCT/EP90/02143 filed Dec. 11, 1990 and based, in turn, upon German National Application P 39 40 960.0 filed Dec. 12, 1989 under the International Convention.

FIELD OF THE INVENTION

The present invention relates to a method for slowing down sheets to be laid on a stack, particularly paper or cardboard sheets, and to a device to implement the method. More particularly, the invention relates to a method of braking sheets, particularly paper or cardboard sheets, to be placed on a stack, whereby the sheets transported at a distance from each other on belts in an feeding plane are slowed down by elements engaging in the area of the rear edge of the sheets.

BACKGROUND OF THE INVENTION

In crosscutting machines which, by crosscutting a web of material, particularly a paper or cardboard web, produce individual sheets to be subsequently deposited on a stack and which operate at high speeds, it is required to slow down the these sheets transported by belts to the stacking location, prior to stacking, in order to insure that the stacking of the sheets is undisturbed.

From DE-B 20 00 078 a generic method is known, according to which the sheets are guided over a fixed suction chamber provided with holes which in a timed manner slows down the trailing edges of the sheets by suction. Subsequently, the sheets are transported to the stacking location by belts running at a speed appropriate for stacking. Since the following sheet runs at first without being braked, its leading edge slides over the trailing edge of the braked sheet, so that the sheets overlap in a scale pattern and are this way transported further. Since the suction acts in each case only upon the lowermost sheet, in multilayered operations wherein for instance eight webs are simultaneously subjected to crosscutting, it is required to provide additional braking for the pack of sheets. This is done by means of a slower running belt portion inclined with respect to the transport plane, against which the leading edge of the sheets of a pack will push.

The known braking devices are expensive structures. It is also possible that, in the case of particularly sensitive papers, marking can occur due to the relative speed with respect to the braking elements. Furthermore, at high operational speeds, sheet jamming may occur.

OBJECTS OF THE INVENTION

It is the object of the invention to provide an improved method and device allowing an increased operational speed with reduced strain on the sheets.

SUMMARY OF THE INVENTION

This object is attained in that in order to be slowed down the sheets are clamped between clamping elements with synchronously and endlessly running clamping zones, which during their revolution temporarily adhere to the sheets.

At the moment of contact with the sheets the clamping zones run at the feeding speed of sheets, subsequently the speed of the clamping zones is slowly reduced to the desired outgoing speed of the sheets, to that the frictional lock with the sheets is maintained, the clamping of the sheets is then released, the clamping zones are removed from the feeding plane prior to the incoming of the next sheet, and the clamping zones are again accelerated to the feeding speed prior to clamping the following sheets. The device for implementing the method has braking sheets displaced along a transport path, the improvement wherein on both sides of the transport path of the sheets synchronously drivable clamping elements with endlessly running clamping zones are provided, whereby the clamping zones of at least one side reach temporarily into the feeding plane during their revolution, so that a sheet can be clamped between two clamping zones. A variable drive is provided for the clamping elements.

According to the invention, the braking force is applied to the sheets without slippage under precisely defined conditions, so that kinematically reproducible conditions exist and no marking can occur. Furthermore, functional and constructional units can be dispensed with in order to obtain a crosscutting machine with an integrated braking device which is less costly to build and has reduced overall dimensions.

According to the invention, the rear edge of the sheets during their contact with the clamping elements are removed by the latter from the feeding plane, preferably downwards. For the purpose of braking, curved clamping zones of stationary, rotating clamping elements roll off the sheets. Moreover, during clamping, the clamping zones move together with the sheets in their travel direction for a certain stretch. According to the invention, in addition, synchronously and variably drivable shafts extending over the work width are provided above and below the transport path of the sheets, and then are fastened in pairs on top of each other at least one approximately annular clamping element with a clamping zone reaching into the feeding plane. The clamping elements can have a cross section which has partially the shape of circular segment and partially an outer diameter which is reduced with respect to the diameter of the circular segment. At least one of the two shafts can be supported to be transversely movable with respect to the transport path.

Preferably, on both sides of the transport path of the sheets, at least one synchronously and variably drivable shaft extending parallel over the work width is provided, whereupon guide pulleys for the endless belts running on both sides of the transport path are fastened, whereby at least the belts on the one side carry each on their outside a clamping body whose surface forms the continuously running clamping zone. On each of the two sides of the transport path two shafts with guide pulleys can be arranged at a distance from each other in the travel direction of the sheets, so that the inner strands of the belts run parallel or inclined in the direction of travel at a sharp angle with respect to the transport path. The clamping bodies which are solid or hollow bodies can be elastically deformable. The clamping bodies of at least one side can be approximately wedge-shaped in the state of nondeformation. Guide pulley of the upper belt on the feeding side can reach up closely to the feeding plane and can the peaks of the wedge-shaped clamping elements point the running direction of the belts.

The distance of the lower belts from the upper belts can correspond approximately to the height of the clamping bodies and the lower belts can also carry wedge-shaped clamping elements whose peaks point against the running direction of belts.

The clamping bodies arranged above the transport path can consist of a clamping part and push-off part, whereby the surface of the clamping part forms the clamping zone and the push-off part is shaped so that prior to clamping it forces the rear edge of sheet downwards and out of the feeding plane.

The inner strands of the belts can each be supported by partially guide plates.

Advantageously, the upper clamping elements are arranged at a distance from each other over the work width, and between the clamping elements guide belts for the sheets running in their travel direction can be provided. At least one variably controlled drive motor can drive the clamping elements directly or through gearing. The variably controlled drive motor can actuate the clamping elements via a variable reducing gearing, particularly clutched gearing. A uniformly driven drive motor, preferably coupled to a flywheel mass, can drive the clamping elements via a variably reducing gear, particularly a clutched gearing, in an alternative, and a further servomotor can act upon the variably reducing gear.

BRIEF DESCRIPTION OF THE DRAWING

The above and other objects, features and advantages of my invention will become more readily apparent from the following description reference being made to the accompanying highly diagrammative drawing in which.

SPECIFIC DESCRIPTION

Figure 1:
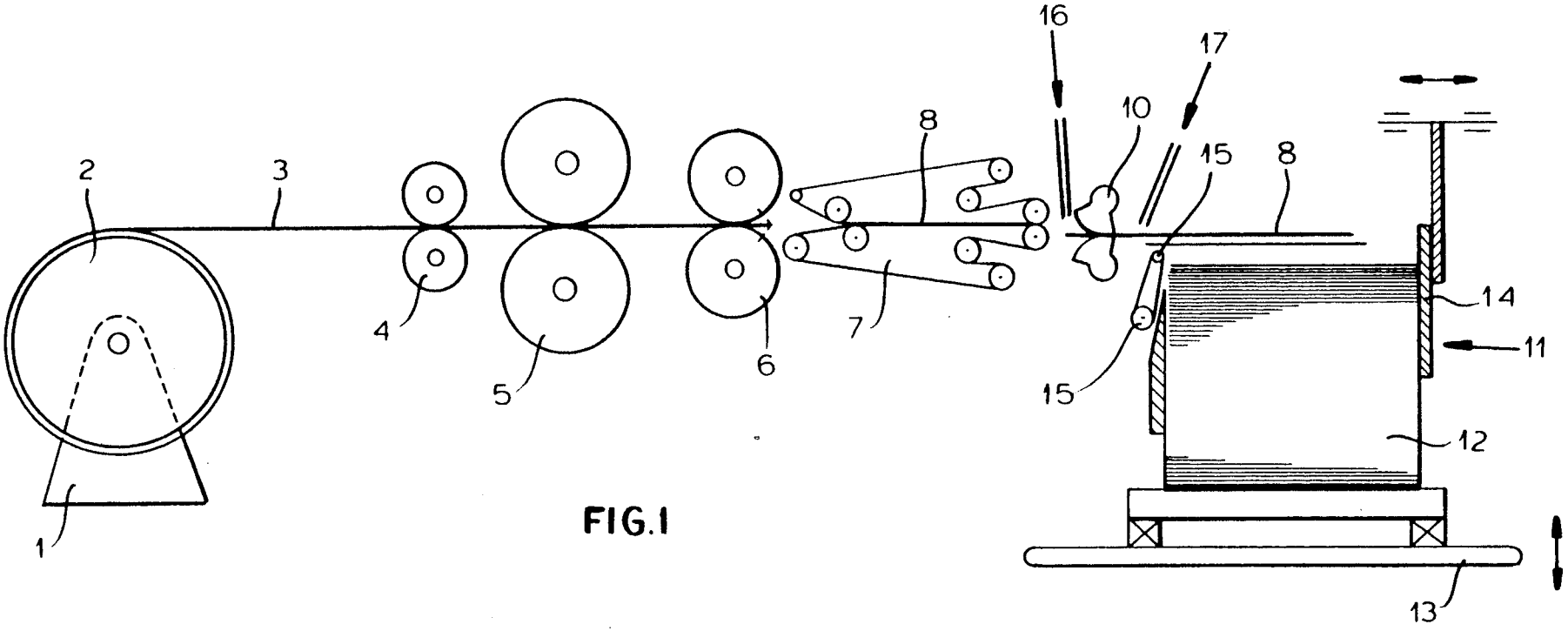
FIG. 1 is a diagrammatic side elevational view of a crosscutting machine with a braking device positioned immediately before the stacking location and which has stationary rotating clamping elements.

The crosscutting machine (FIGS. 1 and 2) has a fitting 1 for dispenser rollers, wherein one or more dispenser rolls 2 can be suspended, wherefrom the material web(oil) 3 which is (are) processed are drawn off. When crosscutting paper, it is possible to guide several (e.g. eight) superposed individual webs through the crosscutting machine and to process them together. The dispenser roll arrangement 1 is succeeded by a longitudinal cutting device 4 which divides the wide material web 3 into several, narrow, adjacent webs. For the forward displacement of the web, an advancement device 5 is provided which directs the webs to the following crosscutting device 6, consisting of two cutter drums each having a crosscutter blade. Subsequently a belt portion 7 is provided which tightens the webs 3 during crosscutting and also accelerates the cut sheets 8, so that a gap is created between the individual sheets 8. For this purpose, the belts of the belt portion 7 run at a speed which is higher by approximately 5 100%, preferably by maximum 30% the speed of the advancement device 5. If high speed rate increases are desirable (more than 10%), the acceleration device is built in several stages.

Figure 2:
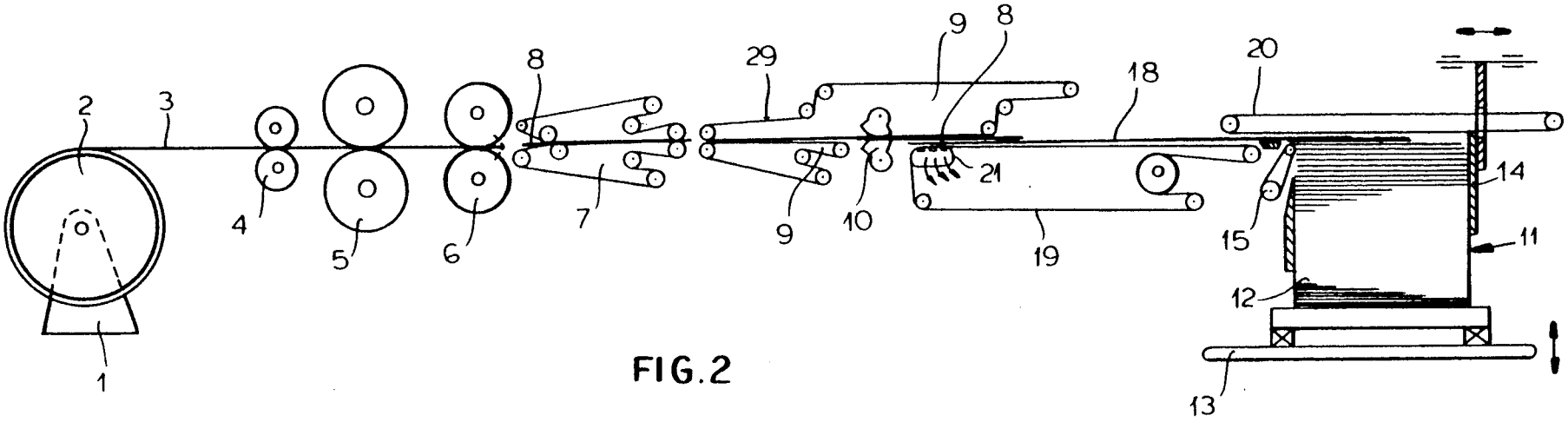
FIG. 2 is a similar view of an embodiment with stationary rotating clamping elements, wherein a scale-patterned flow of sheets is produced prior to stacking.
Figure 5:
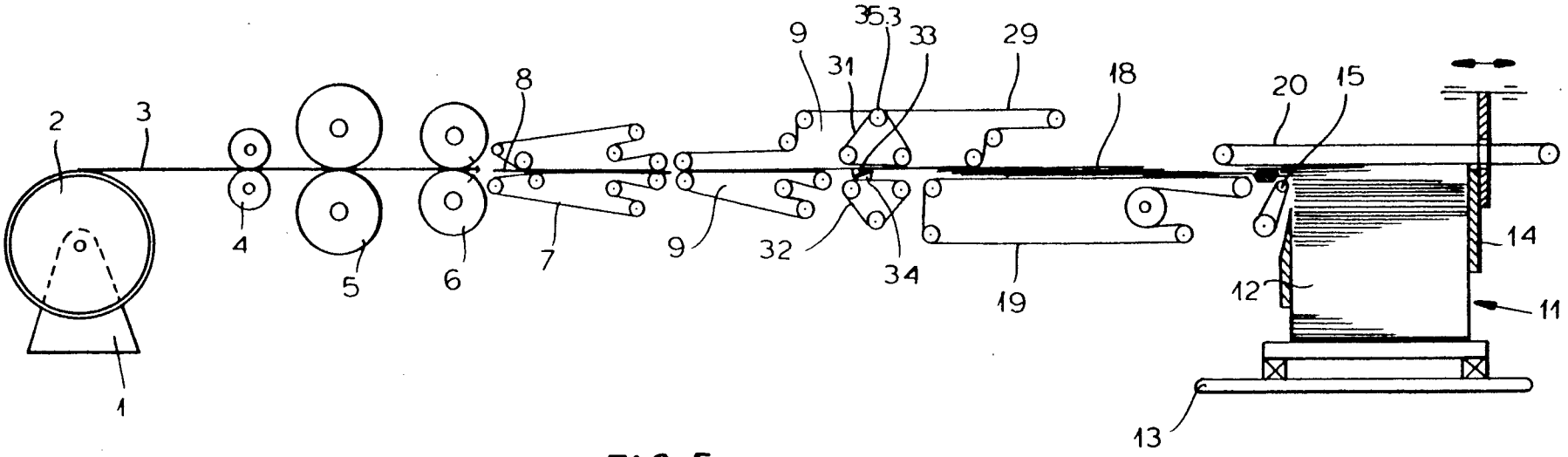
FIG. 5 is a diagrammatic side elevational view of an embodiment with revolving belts, wherein a scale-patterned flow of sheets is produced prior to stacking.

FIGS. 2 and 5 show a two-stage embodiment. There, after the first belt portion 7 a second belt portion 9 is provided, which runs at an even higher speed The belt portions 7 and 9, are followed by a braking device 10 according to the invention. In order to slide each of the trailing sheets 8 on top of the respective leading sheet 8, in the preferred embodiments of the invention shown in the drawing, the transport plane of the braking device 10 is slightly offset downwards with respect to the feeding plane (incoming plane) Alternately, it is also possible to slightly lift the leading edge of the following sheets 8 by blast air, prior to entering the braking device 10.

The braking device 10 is followed by a depositing device 11 consisting of the known element required to form a stack 12: a stacker plate 13 which can be raised and lowered, an adjustable buffer 14 for the leading edges of the sheets, driven output rolls, lateral chute baffles (not shown) and optionally longitudinally running divider plates, in case several stacks have to be built next to each other.

Figure 4:
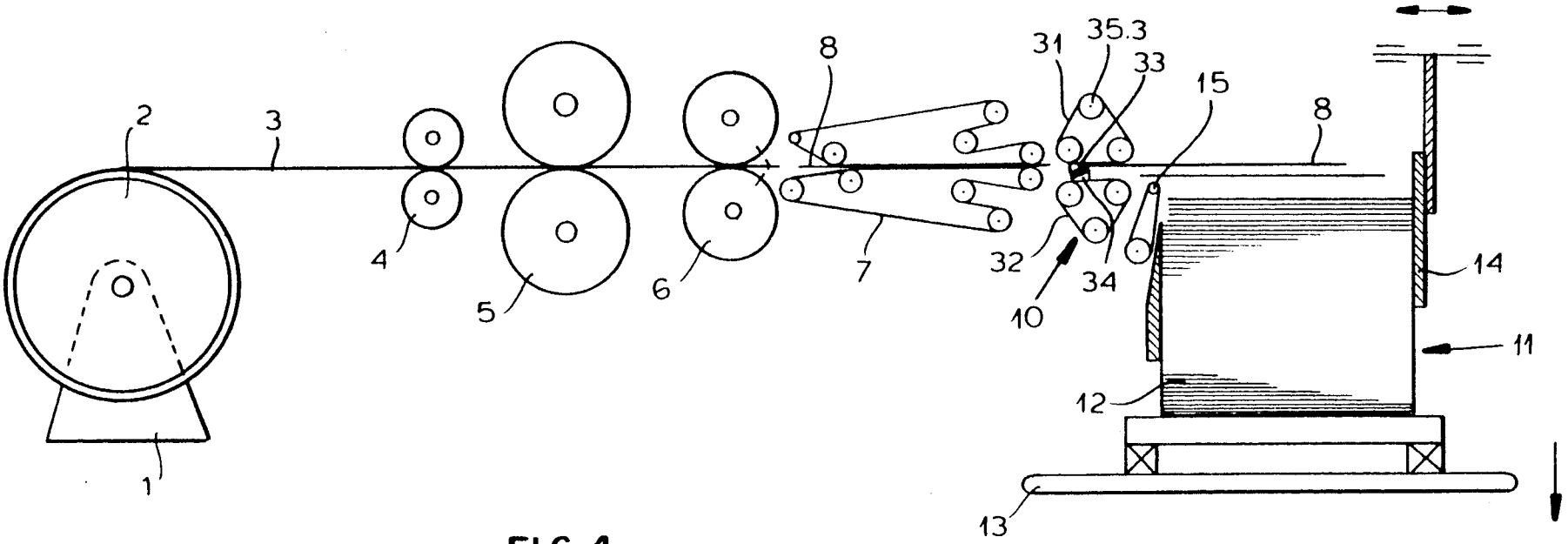
FIG. 4 is a diagrammatic side elevational view of a crosscutter with a braking device arranged immediately before the stacking location, which has revolving belts with attached clamping bodies.

In the embodiments shown in FIGS. 1 and 4, the braking device 10 is located immediately before (upstream of) the stacking location, so that after being slowed down the sheets 8 can be directly stacked. In FIG. 1, upstream and downstream of the braking device, sequentially operated, downwards directed blast nozzles 16, 17, are provided, which press the sheets 8 downwards, in order to free the transport path for the following sheet.

In the embodiment of FIGS. 2 and 5, the braking device 10 is at a distance from the stacker 11. There, first a scale-patterned flow of sheets is created which is then transported via conveyor belt 19 to the stacking location 11 and is stacked there. In these embodiments, the stacker Il comprises the described stacker elements In addition, above the stack 12 upper belts 20 are provided which facilitate the transport onto the stack 12. On the feeding side, the conveyor belt 19 starts at a short distance behind the braking device 10 and its belt portion moving the scale-patterned sheet flow 1B is slightly offset downwardly with respect to the transport path of braking device 10. In the embodiment according to FIG. 2, the conveyor belt is provided with openings and is guided on the feeding side over a sequentially operated suction device (suction box 21), in order to pull down the trailing edges of the braked sheets 8 and to facilitate this way an overlapping of the following sheet 8.

Figure 3:
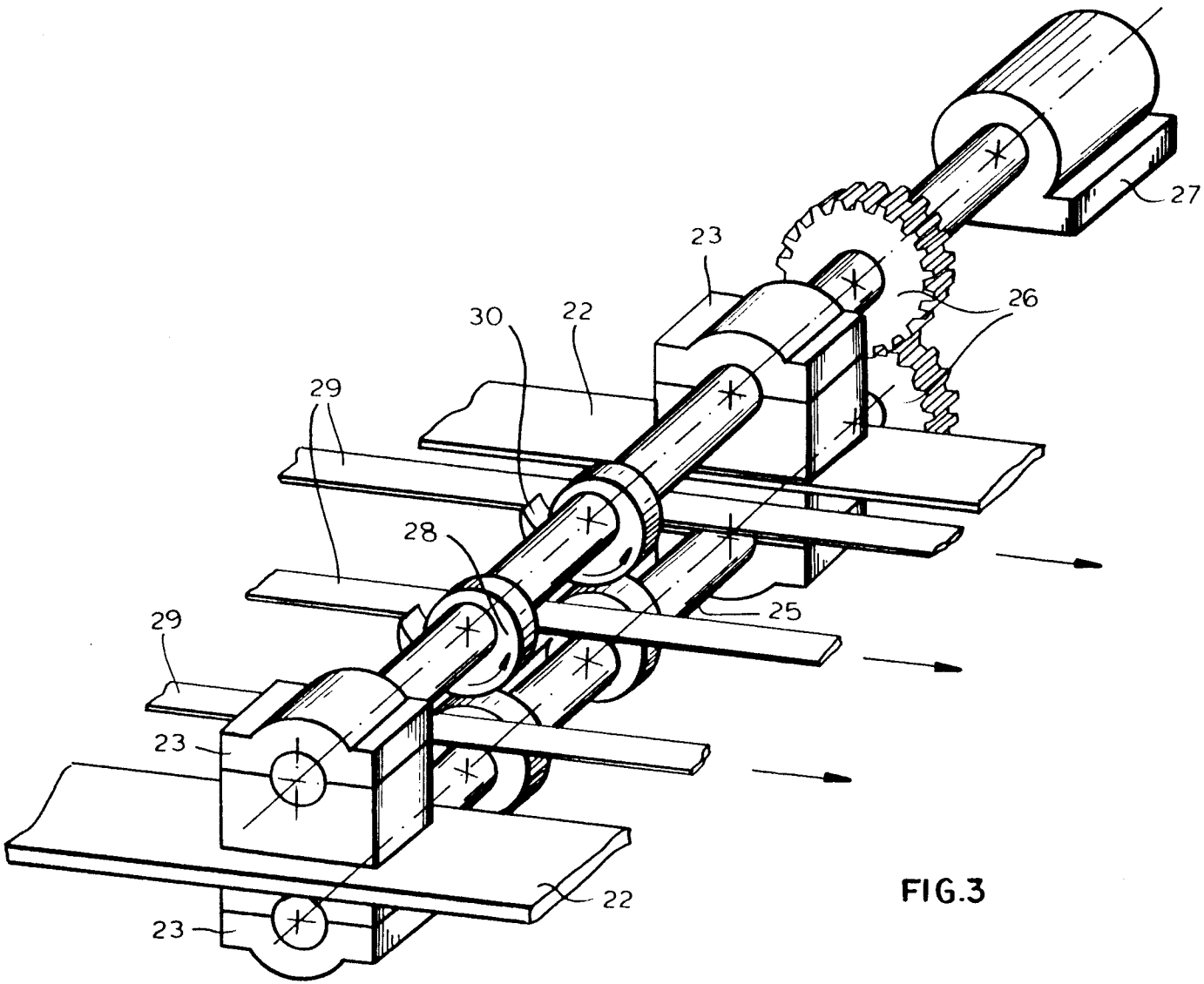
FIG. 3 is an enlarged, perspective view of the braking device according to FIG. 2.

In the embodiments according to FIG. 1 and 2, the braking device 10 has the same construction. In FIG. 3 a detail of FIG. 2 is represented on a larger scale, showing the used braking device 10 in greater detail:

On lateral frame sections 22 of the crosscutting machine, bearing blocks 23 for shafts 24, 25 are mounted, these shafts extending parallelly above and underneath the transport path, across the entire work width The two shafts 24, 25 are driven synchronously in opposite directions via a spur gear 26 by driving motor 27. The driving motor 27 is variably adjusted, in order to variably drive the two shafts 24, i.e. to retard and then again to accelerate the rotational speed. In FIG. 3, the driving motor is directly flanged to the upper shaft 24. If required by the adjustment of the torque and of the rotational speeds, between the driven shaft 24 and the driving motor 27 a gearing with fixed transmission ratio is provided.

In order to vary the nonuniform rotary motion of the two shafts 24, 25 over a range as extensive as possible, depending on the format of sheets 8, the gap between the sheets 8, the feeding speed and the desired output speed, instead of a gear with fixed transmission ratio also a gear with a variable transmission ratio, particularly a clutched gear can be used. Particularly when a further servomotor acts upon the gearing with a variable transmission ratio in order to influence the nonuniformity of the transmission, there are the greatest possibilities to adjust the rotational behavior of the shafts 24, 25 as desired.

As an alternative to a variably adjusted driving motor 27, it is also possible to use a uniformly driven motor, preferably coupled to a flywheel mass. In this case the variable rotary motion of shafts 24, 25 is produced via a gearing with a variable transmission ratio, particularly a coupled gearing Also in this embodiment a further servomotor acts upon the gearing, in order to influence the nonuniformity of rotary motion.

Instead of driving a shaft 25 via the spur gearing 26 it is also possible to connect each individual shaft 24, 25 with one or two driving motors, which are then correspondingly synchronized, either mechanically or electronically. When the space requirements have to be reduced, the driving elements can also be connected laterally at an angle via an angular gearing with the shafts 24, 25. Also it is possible to arrange the driving motors above or preferably underneath the transport path and to connect them via a gear or a belt transmission with the driving shaft 24, 25.

On both the shafts 24, 25 spaced apart clamping elements 28 acting in pairs are fastened, so that the belts 29 of the belt portion 9 can be passed through the spaces between the pairs of clamping elements. In case no belts are supposed to be passed through the braking device 10, e.g. in the embodiment of FIG. 1, the shafts 24, 25 can be designed as clamping rollers with a cross section which is constantly the same in axial direction. In FIG. 3, the individual clamping elements 28 are somewhat annularly shaped, whereby the clamping zones lying against the sheets—lower half of the upper clamping elements 28 in FIG. 3—have in cross section the shape of a circular sector concentric with respect to the shaft 24 or 25. After the clamping zone, the diameter of each clamping element 28 decreases continuously in the direction of rotation, so that a narrowing feeding gap 30 is formed which is curved towards the axis of rotation. A trailing sheet can enter the feeding gap 30 while the leading sheet is held between the two clamping zones. In FIGS. 1 and 2 a further possible cross section of the clamping elements 28 is schematically shown. There on the shafts cams are fastened, whose cross section is shaped like a segment of a circle concentric with respect to the axis of rotation. Further shapes of the cross section of clamping elements 28 are possible, as long as the following requirements are met:

The clamping zone of the clamping element 28, i.e. the circumference engaging the sheets 8, represents only a portion, preferably 15 to 50% of the outer circumference and has in cross section the shape of segment of a circle. The remaining portion of the outer circumference has a reduced diameter, so that during one revolution the clamping element 28 is lifted for a short time from transport path, so that having no contact with the sheets 8 they can again be accelerated. The length of the clamping zone of a clamping element 28 is preferably between 20 and 150 mm. Therefore, when the angular portion of the clamping zone equals approximately 100%, the diameter of the circular portion equals approximately 20–200 mm.

According to another embodiment of the invention, at least one of the shafts 24, 25, preferably both, are supported in bearing blocks 23 so that they are transversely movable with respect to the transport path of the sheets In order to release the contact with sheets 8, the clamping elements are sequentially separated. Therefore, in this embodiment the clamping elements 28 can have a circular cross section. When shafts 24, 25 which can be vertically diverged are used, the acceleration can take place even during the passage of the leading portion of the following sheet 8 without contact.

The aforedescribed device works as follows:

The web taken up from the supply roll 2 is separated by the longitudinal slitter 4 into individual webs of the desired width and subsequently cut by the crosscutting device 6 into sheets of the desired length. After crosscutting, the sheets 8 are taken over by the belt portions 7, 9 and transported further with acceleration, so that a gap is created between the sheets 8 succeeding each other. The length of this gap can be adjusted through the acceleration ratio of the belt portions 7, 9; preferably their speed is increased by approximately 5 to 50% in comparison to the preceding speed, so that a gap whose length equals approximately 5–50% of the format length is created.

At the end—of the preferably multistage—acceleration, the braking device 10 engages the trailing edge of the sheet frictionally and slippage free. For this purpose, at the moment of contact with the sheets 8, the clamping zones of clamping elements 28 are accelerated to the feeding speed by the variable driving motor 7. When the sheets 8 are clamped between the clamping elements, the rotational speed of the clamping elements 28 is reduced, until the sheets have reached the desired outlet speed. The retardation takes place so slowly that, the frictional lock between the sheets 8 and the clamping elements 28 is preserved, i.e. the retardation takes place over the longest possible stretch. It has been proven that in the case of a deceleration stretch of 20 to 150 mm, speeds of several hundred m/min can be reduced to such low speeds that a safe and damage-free depositing on the stack 12 (either directly or in a scale-patterned flow) becomes possible.

In order to make possible the overlapping of the following sheets 8 due to the retardation, the passage for the following sheet 8 coming at a high speed has to be freed. Therefore, the rotating clamping elements are built so that they automatically lift off the sheets 8 after the deceleration stretch, in order to make possible the arrival of succeeding sheet 8. This can be achieved through a special configuration of the cross section or through the divergence of the two shafts 24, 25. In the subsequently described embodiment according to FIGS. 4 to 9, a deceleration stretch as long as possible without collision with the following sheets 8 is achieved as a result of the fact that during deceleration the clamping bodies 33, 34 of the clamping elements 28 are concurrently moved over a certain portion, in the travel direction of the sheets. Prior to the contact of the clamping zones of clamping elements 28 with the following sheets, i.e. before or while they are coming in, the driving motor 27 brings the clamping zones of the clamping elements 28 up again to the feeding speed. This way a slippage-free contact with the succeeding sheet 8 is possible.

In order to insure the overlapping of the following sheet 8, the latter has to be moved on a slightly higher level over the preceding sheet 8. In the embodiment according to FIG. 1, this is achieved due to the arrangement of braking device 10 which is slightly downwardly offset, so that during braking the sheets 8 are at the same time moved downwards. This movement is supported by blast air coming from nozzles 16, 17.

In the embodiment of FIG. 2, the following conveyor belts 19 are slightly downwardly offset. There, the trailing edges of the sheets are pulled downwards by the air suction coming from suction box 21. It is also possible to slightly lift the leading edge of the following sheet 8 by blast air.

In FIG. 1, the braked sheets 8 are directly guided towards the stacker 11. The delivery speed when exiting the braking device 10 is selected so that residual energy of the sheets 8 is sufficient for them to reach the stack 12 in free flight.

According to FIG. 2, on the conveyor belts 19 at first a scale-patterned flow is produced, which is then directed in the known manner to the stacker 11 where it is stacked.

In order to keep the danger of markings as low as possible while the sheets 8 are subjected to the braking strain, the tendency is to keep the braking acceleration as low as possible. At high feeding speeds, this requires a correspondingly long braking stretch for the sheets 8. With the approximately annular clamping elements, wherein the braking stretch is determined by the increased portion of the outer circumference, the stretch can be increased only to a limited extent. If the braking portion is increased at the outer diameter while the diameter stays the same, at the same time the portion with decreased diameter required for the acceleration back to the feeding speed and the unbraked feeding of the following sheet is also reduced. For this function, a minimum stretch is required, which should not be shortened below this minimum.

If the attempt is made to obtain a long braking stretch and at the same time a sufficiently long moving stretch without contact with the sheets 8 by increasing the diameter of the clamping elements, because of exponential increase of the moments of inertia a limit is reached when the required acceleration moments can no longer be achieved.

In order to keep the movement stretch which has no contact with the sheets independent from the braking stretch, in another embodiment of the invention not represented in the drawing guide wheels for endless belts are fastened. On their outside, the belts carry at least one clamping body whose surface forms the circular clamping zone. Preferably a toothed belt and toothed belt pulleys are used, in order to transmit high acceleration values from the shafts 24, 25 without slippage. The clamping bodies are preferably shaped somewhat like a wedge and are elastically deformable and their construction corresponds to the clamping bodies which are subsequently closer described in the embodiments according to FIGS. 5 to 9.

In the aforedescribed embodiments of the invention, the clamping elements, respectively the clamping bodies roll off the sheets at the braking contact with the sheets 8. It is therefore necessary that at the beginning of the braking process the clamping elements respectively clamping bodies come down at a distance from the rear edge of the sheet, a distance which corresponds at least to the braking stretch. This is a drawback, since especially in softer types of paper the free end, which is not clamped, of sheet 8 tends to slide forwards and to crumple. This effect is even more noticeable in sensitive papers which are supposed to be supplied at high feeding speeds and slowed down over the longest possible braking stretch. FIGS. 5 to 9 show a preferred embodiment wherein this disadvantage is avoided. The clamping zones of the clamping elements adhere to the sheets 8 with shortest possible distance from their rear edge. Subsequently, during the slowdown they are moved along in the travel direction of the sheets over a certain stretch which corresponds to the desired braking stretch. In this way it is possible to effect the slowdown over a longer stretch with reduced acceleration values and to allow the clamping zones of the clamping elements to adhere to the rear edges of the sheets at the start of the braking process, without leaving a free end of the sheet.

Figure 6:
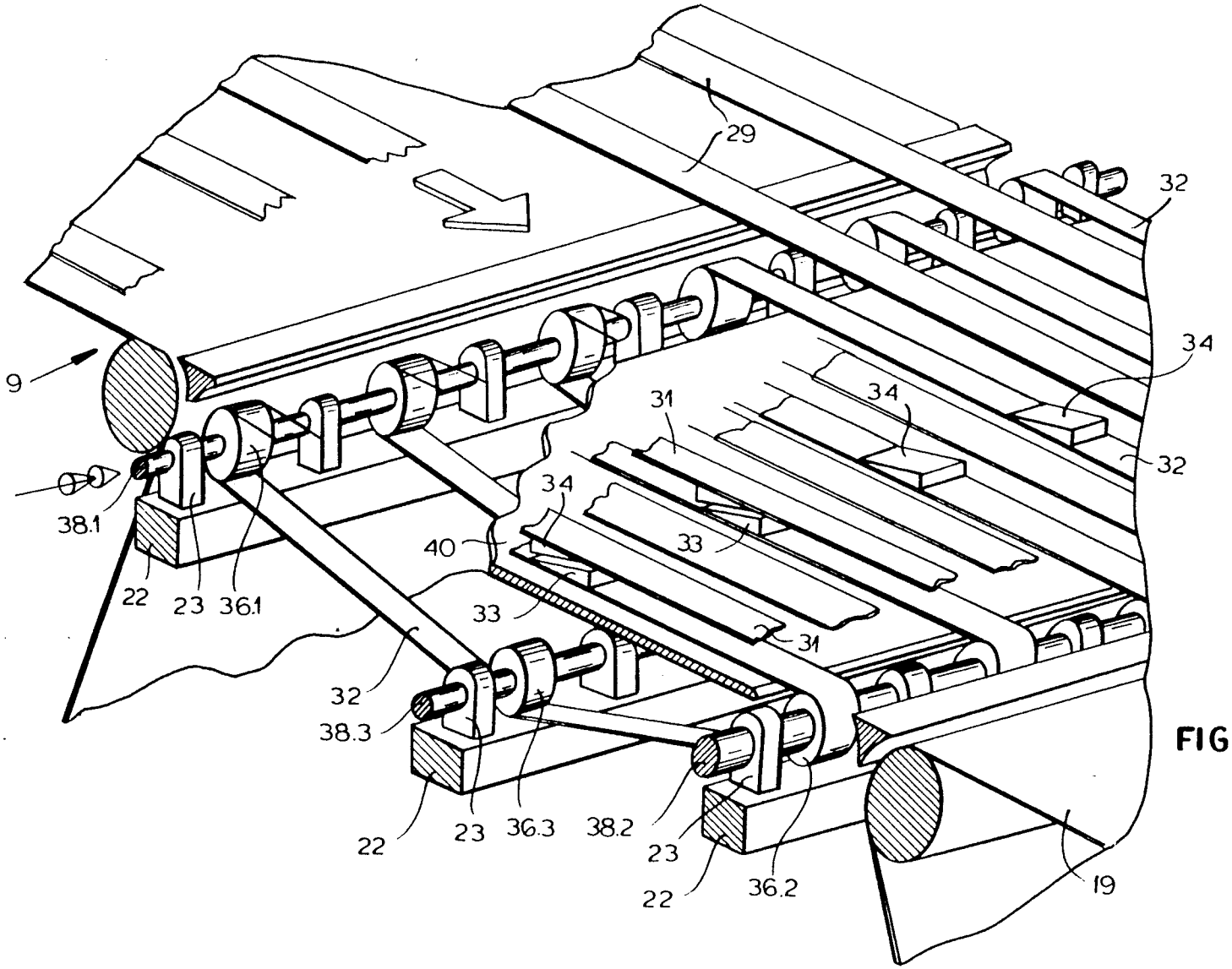
FIG. 6 is shows an enlarged, perspective view of a braking device according to the embodiment of FIG. 5.

The basic construction of the crosscutting machine shown in FIGS. 4 and 5 corresponds to that of FIGS. 1 and 2, except for the fact that the braking device shown in detail in FIG. 6 has been incorporated. It is possible to arrange the braking device immediately before the stacking point 11 (FIG. 4), or at first to produce a scale-patterned flow which is subsequently stacked (FIG. 5).

The braking device 10 shown in FIG. 6 in a partially sectioned and perspective view consists of continuous belts 31, 32 each running parallelly to the transport path and at a distance from each other, each having a wedge-like clamping body 33, 34 or several equidistant clamping bodies fastened to its outside. The clamping bodies 33, 34 are either solid or hollow bodies and elastically deformable, e.g. made of polyurethane or another soft material. Each one of the belts 31, 32, which are toothed on the inside, are guided by three belt sprockets 35.1–35.3, 36.1–36.3 which are spaced apart and fastened to the shafts 37.1–37.3, 38.1–38.3 extending across the work width. Two shafts 37.1, 37.2, or 38.1, 38.2 are arranged in the travel direction of the sheets, at a distance from each other, respectively above and below the transport path of sheets 8, so that over a certain stretch the inner strands of the belts 31 or 32 run either parallelly to the transport path or inclined in the travel direction at a sharp angle with respect to the travel path. This stretch represents the maximum braking stretch. The distance between the shafts 37.1, 37.2 respectively 38.1, 38.2 is between 50 mm and the maximal format length, preferably between 50 mm and 200 mm. A respective third shaft 37.3, 38.3 is arranged at a distance above and below the transport path. In the present example, the guide sprockets 35.1 on the feeding side of the upper belt 31 reach up to the feeding plane of sheets 8. The peaks of the thereto fastened wedge-like clamping bodies 33 point in the running direction of the belts. The guide sprockets 36.1, 36.2 of the lower belt 32 are arranged so that the distance between the upper strands of the lower belts 32 and the lower strands of the upper belts 31 corresponds to the height of clamping bodies 33, 34. The peaks of the wedge-like clamping bodies 34 of the lower belt 32 are pointed against the running direction of belts 32.

Each of the shafts 37.1, 37.8 above and below on the feeding side are connected to a variable drive. The drives consist of the combinations of motor and gearings described in the embodiment example according to FIGS. 1 to 3. The belt guide pulleys 35.1–35.3, 36.1–36.3, whose width corresponds to the width of the belts 31, 32 ( in the present example the width being approximately 25 mm) are arranged at a distance of approximately 100 mm – 150 mm from each other, across the work width. The diameter of the guide pulleys 35.2, 36.2 on the exit side is as small as possible, so that the clamping bodies 33, 34 move quickly out of the transport path; in the example the diameter is of approximately 40 mm. The guide pulleys on the feeding side 35.1, 36.1 can have a larger diameter, in order to adjust the rotational speed to the desired belt running speed; in the example their diameter equals 60 mm. Between the inner strands of the upper belts 31 run the belts 29 of the belt portion 9. They guide the sheets 8 on their upper parts during braking. The inner strands of belts 31, 32 are supported by parallel guide plates 39, 40 at their sides facing away from the sheets 8.

In the embodiments according to FIGS. 4 to 9, the respective inner strands of the upper and lower belts 31, 32 are arranged parallel to the feeding plane of sheets 8. Each sheet 8 is pushed downwards with respect to the feeding plane by the upper clamping bodies 33, in order to free the feeding plane for the following sheet 8. In this way, the wedge-shaped clamping bodies 33 perform the function of forcing off the sheets 8 as well as the function of clamping. It is possible to shape the clamping bodies so that both these functions are separated. Then, each of the upper clamping bodies is provided first with a push-off part and with a following clamping part. For instance, brushes can be fastened to the belt 31 before the clamping part, to function as push-off parts. In this case the clamping part can have a rectangular cross section, e.g. be a rigid body with an elastic overlay. Thereby it has to insured that the rigid body can be deflected by guide pulleys 35.1–35.3.

According to another embodiment of the invention, each of the inner belt strands is not parallel to the transport path of sheets 8, but is at least partially inclined at an sharp angle in the travel direction of the sheets. During braking, the clamping bodies 33, 34 perform an additional, slightly downward movement and in this way free the feeding level for the following sheet 8.

Figure 7:
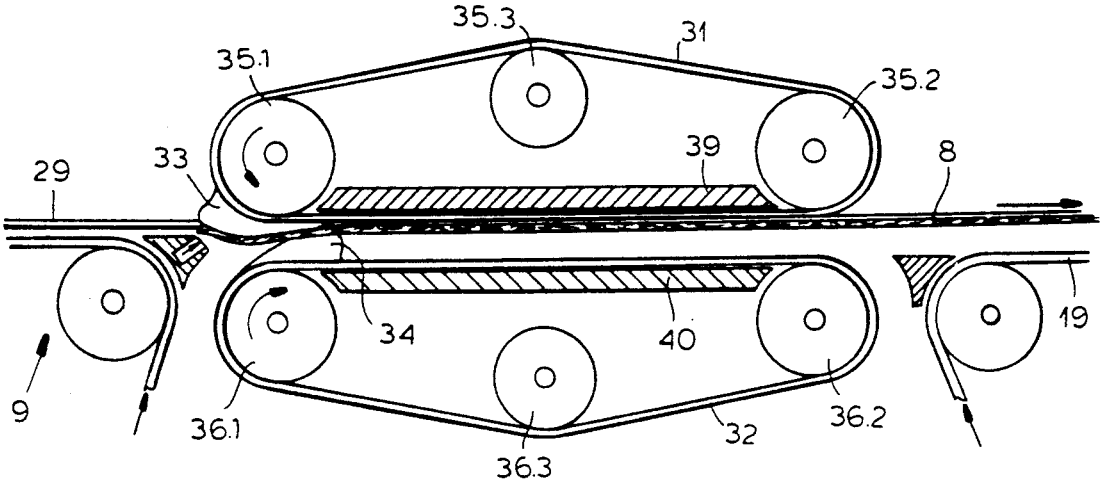
FIGS. 7 to 9 are cross sectional views which show the functional sequence during the slowdown of a sheet in the embodiment according to FIG. 6
Figure 8:
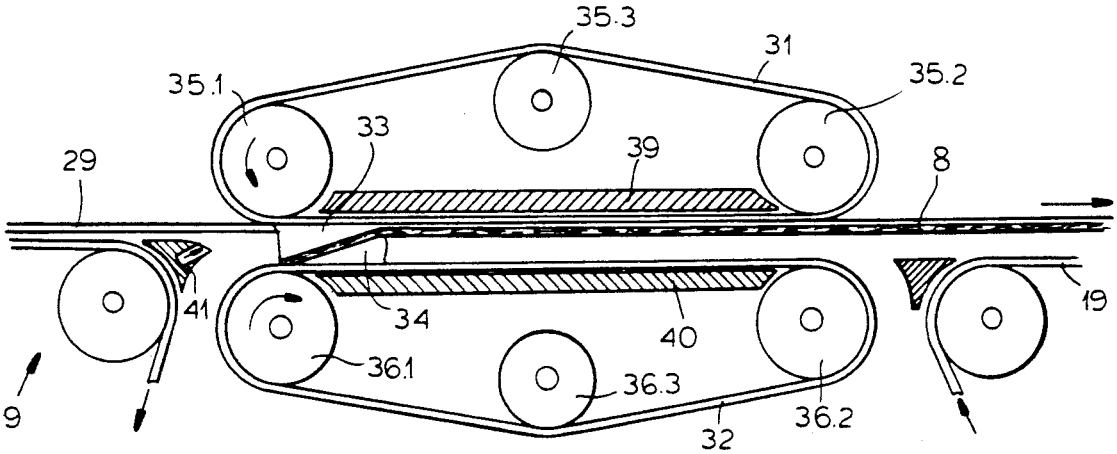
Figure 9:
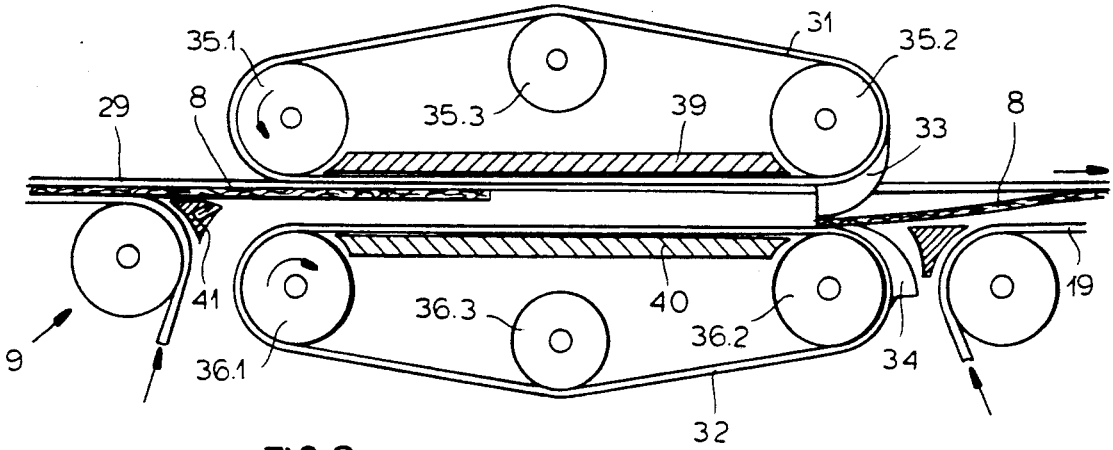

The slowdown process is represented in FIGS. 7 to 9. The running of the belts 31, 32 is adjusted so that the clamping bodies 33, 34 engage the sheets 8 with their clamping zones as precisely as possible at their trailing edge and hold it fast. The trailing edge of the sheet is pushed downwards by the upper clamping body 33 against the synchronously moving lower clamping body 34 and is this way clamped between the two (FIG. 8). In the engagement of clamping bodies 33, 34 with the sheets 8 as shown in FIG. 7, the clamping bodies move at the feeding speed of sheets 8 , so that they lock onto them frictionally and without slippage. As soon as the trailing edge of the sheet is clamped between them—or slightly later when a shorter braking stretch is sufficient—the running speed of the belts 31, 32 is lowered slippage-free to the desired exiting speed, so that the sheets 8 do not move relatively to the clamping bodies 33, 34. Thereby, the leading edge of the following sheet 8 comes closer, i.e. the gap between the two sheets 8 narrows. When it leaves the lower belt of the belt portion 9, the following sheet 8 is kept on the feeding level by the compressed air supplied by an upwardly blowing nozzle 41, until the clamping bodies 33, 34 engage its trailing edge. Before the leading edge of the following sheet 8 has caught up with the upper clamping body 33, the latter detaches itself from the braked sheet 8 and is removed from the feeding plane. As a result of the slowdown, the forerunning sheet 8 has left the belts 29 and rests now on the discharge belts 19 , which are slightly offset downwardly. In this way, the leading edge of the following sheet 8 can at this point slide over the trailing edge of the forerunning sheet 8 and a scale-patterned flow is created. Before the rear edge of the following sheet 8 has reached the guide pulleys 35.1, 36.1 on the feeding side, the belts 31, 32 are again synchronously accelerated to the feeding speed of sheets 8. In this way they can again engage and clamp the rear edge of an incoming sheet without slippage, for the purpose of braking.

We claim:

1. A method of braking paper sheets, comprising the steps of:

(a) transporting said sheets in spaced-apart relationship on belts in a feeding plane at a feeding speed in a direction of feed;

(b) gripping rear edges of said sheets with clamping zones of two clamping belts continuously moving in an endless path, and deflecting a rear end of each sheet downwardly about an axis perpendicular to said direction of feed and relative to the remainder of said sheet out of said plane;

(c) displacing said clamping zones at said feeding speed of said sheets at a moment of contact of said zones with said sheets and moving said clamping zones with a sheet to be engaged for a stretch of said path coinciding with movement of said sheet to be engaged in said plane;

(d) thereafter slowly reducing a speed of said clamping zones to a desired outgoing speed of said sheets while maintaining each sheet frictionally locked with said clamping zones;

(e) thereafter releasing the sheet previously held by said clamping zones from the clamping element;

(f) then removing said clamping zones from said feeding plane prior to an arrival of a subsequent sheet;

(g) thereafter accelerating said clamping zones to said feeding speed prior to engagement of said subsequent sheet with said clamping zones; and (h) repeating steps (b) through (g) for each of the sheets to be braked.

2. An apparatus for feeding and braking paper sheets, comprising:

at least one feed belt a succession of sheets in spaced-apart relationship in a feeding plane at a feeding speed along a transport path in a direction of feed;

synchronously drivable clamping elements having endlessly running clamping zones on opposite sides of said transport path, clamping zones on at least one of said sides being constructed and arranged to reach temporarily into said feeding plane during displacement thereof along a respective endless path for clamping each sheet between two clamping zones in said plane, said clamping zones being shaped to deflect a rear end of each sheet downwardly about an axis perpendicular to said direction of feed and relative to the remainder of said sheet out of said plane;

variable drive means for said clamping elements for cyclically:

displacing said clamping zones at said feeding speed of said sheets at a moment of contact of said zones with said sheets and moving said clamping zones with a sheet to be engaged for a stretch of said transport path coinciding with movement of said sheet to be engaged in said plane, thereafter slowly reducing a speed of said clamping zones to a desired outgoing speed of said sheets while maintaining each sheet frictionally locked with said clamping zones, thereafter releasing the sheet previously held by said clamping zones from the clamping elements then removing said clamping zones from said feeding plane prior to an arrival of a subsequent sheet, and thereafter accelerating said clamping zones to said feeding speed prior to engagement of said subsequent sheet with said clamping zones; and means for supporting said clamping elements and including:

a respective pair of shafts spaced apart along said transport path in a feed direction above said plane and a respective pair of shafts spaced apart along said transport path in said direction below said plane, respective pulleys on said shafts, and respective upper and lower clamping belts guided on said pulleys, said clamping belts having inner stretches juxtaposed with one another and carrying said clamping zones, said clamping zones engaging said sheets along said inner stretches.

3. The apparatus defined in claim 2 wherein said zones are elastically deformable.

4. The apparatus defined in claim 3 wherein the clamping zones of at least one of said upper and lower clamping belts are approximately wedge shaped in an undeformed state.

5. The apparatus defined in claim 4 wherein all of said clamping zones are wedge shaped and a peak of a wedge-shaped clamping zone of the upper belt points in a running direction thereof and a peak of a wedge-shaped zone of the lower belt points in a direction opposite to the running direction.

6. The apparatus defined in claim 5 wherein a distance of said lower belt from said upper belt corresponds approximately to a height of said wedge-shaped zones.

* * * * *